US009273856B2

(12) United States Patent
Yang et al.

(10) Patent No.: US 9,273,856 B2
(45) Date of Patent: Mar. 1, 2016

(54) OPTO-MECHANICALLY ADJUSTABLE AND EXPANDABLE LIGHT BOARDS

(71) Applicants: Yi Yang, Liverpool, NY (US); Daniel Robert Treible, Jr., Clay, NY (US)

(72) Inventors: Yi Yang, Liverpool, NY (US); Daniel Robert Treible, Jr., Clay, NY (US)

(73) Assignee: Cooper Technologies Company, Houston, TX (US)

( * ) Notice: Subject to any disclaimer, the term of this patent is extended or adjusted under 35 U.S.C. 154(b) by 23 days.

(21) Appl. No.: 14/180,140

(22) Filed: Feb. 13, 2014

(65) Prior Publication Data

US 2015/0226413 A1 Aug. 13, 2015

(51) Int. Cl.

| | |
|---|---|
| ***F21S 4/00*** | (2006.01) |
| ***F21V 21/30*** | (2006.01) |
| ***F21S 8/00*** | (2006.01) |
| ***F21S 9/00*** | (2006.01) |
| ***F21V 21/15*** | (2006.01) |
| *F21W 131/40* | (2006.01) |

(52) U.S. Cl.

CPC . *F21V 21/30* (2013.01); *F21S 8/00* (2013.01); *F21S 9/00* (2013.01); *F21V 21/15* (2013.01); *F21W 2131/40* (2013.01)

(58) Field of Classification Search

CPC ..... F21V 21/30; F21V 21/15; F21V 21/26; F21V 1/06; F21V 1/08; F21V 14/02; F21V 17/02; F21V 17/08; F21V 17/107; F21V 21/08; F21V 21/14; F21V 21/28; F21V 21/34; F21V 33/012; F21S 9/00; F21S 8/00; F21W 2131/40

USPC ..... 362/249.03, 249.01, 255, 235, 249.02; 352/183

See application file for complete search history.

(56) References Cited

U.S. PATENT DOCUMENTS

| | | | | |
|---|---|---|---|---|
| 4,525,773 | A * | 6/1985 | Hesse et al. | 362/413 |
| 7,311,423 | B2 | 12/2007 | Frecska et al. | |
| 7,637,636 | B2 | 12/2009 | Zheng et al. | |
| 7,665,862 | B2 * | 2/2010 | Villard | 362/249.02 |
| 7,703,941 | B2 | 4/2010 | Lee | |
| 7,810,968 | B1 | 10/2010 | Walker et al. | |
| 7,854,534 | B2 | 12/2010 | Liu | |
| 7,926,982 | B2 | 4/2011 | Liu | |
| 7,988,335 | B2 | 8/2011 | Liu et al. | |
| 8,002,438 | B2 * | 8/2011 | Ko | 362/249.1 |
| 8,025,428 | B2 * | 9/2011 | Duguay et al. | 362/311.02 |
| 8,092,047 | B2 * | 1/2012 | Ma et al. | 362/249.02 |
| 8,454,194 | B2 | 6/2013 | Liu | |
| 8,459,835 | B2 | 6/2013 | Liu et al. | |
| 8,529,076 | B2 * | 9/2013 | Chang | 362/35 |
| 8,770,816 | B2 * | 7/2014 | Parker et al. | 362/609 |
| 2010/0118532 | A1 | 5/2010 | Liang et al. | |
| 2010/0172133 | A1 | 7/2010 | Liu | |
| 2010/0220046 | A1 | 9/2010 | Plotz et al. | |

(Continued)

*Primary Examiner* — Anh Mai
*Assistant Examiner* — Matthew Peerce
(74) *Attorney, Agent, or Firm* — King & Spalding LLP

(57) ABSTRACT

A mounting platform for a light board is described herein. The mounting platform can include a fixture coupling portion having at least one fixture receiving feature, where the at least one fixture receiving feature is configured to couple to a light fixture. The housing can also include a light board coupling portion having at least one light board coupling feature, where the at least one light board coupling feature is configured to couple to at least one light board. The housing can further include an intermediate portion coupled to and positioned between the fixture coupling feature and the light board coupling feature, where the intermediate portion forms a first angle with the fixture coupling feature and a second angle with the light board coupling feature.

18 Claims, 6 Drawing Sheets

(56) References Cited

U.S. PATENT DOCUMENTS

| | | | | |
|---|---|---|---|---|
| 2011/0109235 | A1 | 5/2011 | Link | |
| 2011/0310600 | A1 | 12/2011 | Lehman et al. | |
| 2012/0033426 | A1* | 2/2012 | Wendt | 362/249.03 |
| 2012/0140468 | A1* | 6/2012 | Chang | 362/235 |
| 2012/0155080 | A1 | 6/2012 | Schupple et al. | |
| 2012/0300460 | A1 | 11/2012 | Liu et al. | |
| 2013/0087722 | A1 | 4/2013 | Brown | |
| 2013/0088871 | A1 | 4/2013 | Yun et al. | |
| 2013/0229802 | A1 | 9/2013 | Fukushima et al. | |
| 2013/0235583 | A1 | 9/2013 | Chang et al. | |
| 2014/0003053 | A1* | 1/2014 | Musser et al. | 362/249.03 |
| 2015/0070892 | A1* | 3/2015 | Witsch | 362/249.03 |
| 2015/0117005 | A1* | 4/2015 | Zanotto | F21S 4/008 362/249.1 |

* cited by examiner

OPTO-MECHANICALLY ADJUSTABLE AND EXPANDABLE LIGHT BOARDS

CROSS-REFERENCE TO RELATED APPLICATIONS

The present application is related to U.S. patent application Ser. No. 14/180,118 titled "Opto-Mechanically Adjustable and Expandable Light Fixtures," which is being filed concurrently with the U.S. Patent and Trademark Office, and is hereby incorporated by reference.

TECHNICAL FIELD

The present disclosure generally relates to light boards of light fixtures and, particularly, to adjustable and expandable light boards.

BACKGROUND

Light fixtures are used in a number of different applications. Many of these applications can apply to an industrial setting or similar settings where the light fixtures are mounted a large distance from where the light emitted by the light fixtures is projected. Having the capability to adjust such light fixtures to alter the intensity and/or distribution of the light emitted by the light fixtures can be useful.

SUMMARY

In general, in one aspect, the disclosure relates to a mounting platform for a light board. The mounting platform can include a fixture coupling portion having at least one fixture receiving feature, where the at least one fixture receiving feature is configured to couple to a light fixture. The mounting platform can also include a light board coupling portion having at least one light board coupling feature, where the at least one light board coupling feature is configured to couple to at least one light board. The mounting platform can further include an intermediate portion coupled to and positioned between the fixture coupling feature and the light board coupling feature, where the intermediate portion forms a first angle with the fixture coupling feature and a second angle with the light board coupling feature.

In another aspect, the disclosure can generally relate to a light fixture. The light fixture can include at least one first light board. The light fixture can also include a housing having a first housing portion, where the first housing portion includes at least one first component receiving feature. The light fixture can further include a first mounting platform. The first mounting platform of the light fixture can include a first fixture coupling portion having at least one first housing receiving feature, where the at least one first housing receiving feature is configured to couple to the at least one first component receiving feature of the first housing portion. The first mounting platform of the light fixture can also include a first light board coupling portion having at least one first light board coupling feature, where the at least one first light board coupling feature is configured to couple to at least one first light board. The first mounting platform of the light fixture can further include a first intermediate portion coupled to and positioned between the first fixture coupling feature and the first light board coupling feature, where the first intermediate portion forms a first angle with the first fixture coupling feature and a second angle with the first light board coupling feature.

These and other aspects, objects, features, and embodiments will be apparent from the following description and the appended claims.

BRIEF DESCRIPTION OF THE DRAWINGS

For a more complete understanding of the example embodiments and the advantages thereof, reference is now made to the following description, in conjunction with the accompanying figures briefly described as follows.

Figure 1A:
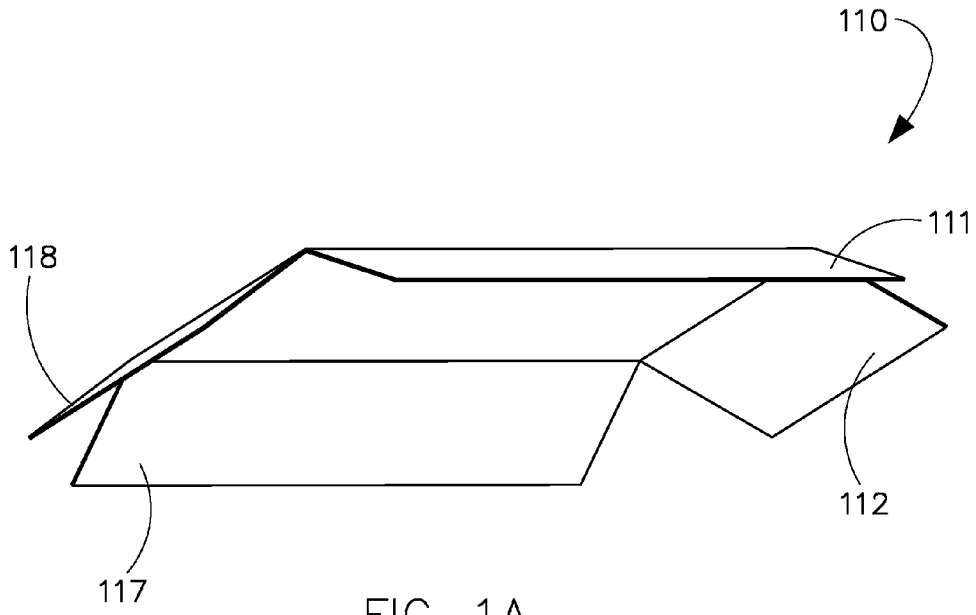
FIGS. 1A and 1B show various views of a housing of a light fixture in accordance with certain example embodiments.

The drawings illustrate only example embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

The example embodiments discussed herein are directed to systems, apparatuses, and methods of adjustable and/or expandable light boards of a light fixture. Such light fixtures can be one or more of a number of types of light fixtures used in one or more of a number of applications. One example of a type of light fixture is a high-bay light fixture. Example embodiments can be used with in one or more of a variety of environments, indoors or outdoors, where the light fixture can be exposed. Examples of such environments can include, but are not limited to, moisture, humidity, dirt, exhaust fumes, vibrations, potential explosions, and noise.

Example light boards can use light-emitting diode (LED) technology. If a light disposed on a light board is a LED, the LED can be of one or more of a number of types of LED technology, including but not limited to discrete LEDs, LED arrays, chip-on-board LEDs, edge lit LED panels, and surface mounted LEDs. Example light boards can also be used with different types of light sources using one or more of a number of types of sockets into which the light sources are electrically and mechanically coupled. Examples of a socket can include, but are not limited to, an Edison screw base of any diameter (e.g., E26, E12, E 14, E39), a bayonet style base, a bi-post base, a bi-pin connector base, a wedge base, and a fluorescent tube base. A light source can electrically and mechanically couple to the socket and can be of a light source type that corresponds to the socket. Examples of light source types of the light source can include, but are not limited to, incandescent lamps, LEDs, halogen lamps, G10/GU10, G9/GU9, AR111/PAR36, T3, MR-11, and MR-16.

Example light boards can be of any size and/or shape, and can have any number of sockets and/or wires. A light fixture that uses example light boards can be mounted to a surface (e.g., wall, ceiling, pillar), be part of a lamp, or be used with any other suitable mounting instrument. Such light fixtures can be used in residential, commercial, and/or industrial applications. Such light fixtures can operate from a manual device (e.g., on/off switch, dimming switch, pull chain), a photocell, a timer, and/or any other suitable mechanism.

The example light boards and their associated fixtures (or components thereof) described herein can be made of one or more of a number of suitable materials to allow the light boards and/or fixtures to meet certain standards and/or regulations while also maintaining durability in light of the one or more conditions under which the example light boards and/or fixtures can be exposed. Examples of such materials can include, but are not limited to, aluminum, stainless steel, fiberglass, glass, plastic, and rubber.

Light fixtures using example light boards described herein can be rated for one or more of a number (or range) of light color (CCT), light rendering (CRI), voltages, and/or amperes. Example light fixtures described herein should not be considered limited to a particular CCT, CRI, voltage, and/or amperage rating. A user may be any person who interacts with an example light fixture. Specifically, a user may install, maintain, operate, and/or interface with a light fixture that includes one or more example light boards. Examples of a user may include, but are not limited to, an engineer, an electrician, an instrumentation and controls technician, a mechanic, an operator, a consultant, a contractor, and a manufacturer's representative.

Example embodiments of opto-mechanically adjustable and/or expandable light boards will be described more fully hereinafter with reference to the accompanying drawings, in which example light fixtures are shown. Opto-mechanically adjustable and/or expandable light boards may, however, be embodied in many different forms and should not be construed as limited to the example embodiments set forth herein. Rather, these example embodiments are provided so that this disclosure will be thorough and complete, and will fully convey the scope of opto-mechanically adjustable and/or expandable light boards to those or ordinary skill in the art.

Like, but not necessarily the same, elements (also sometimes called components) in the various figures are denoted by like reference numerals for consistency. Terms such as "first," "second," "side," and "end" are used merely to distinguish one component (or part of a component) from another. Such terms are not meant to denote a preference or a particular orientation. Further, for any figures described below, labels not shown in such figures but referred to with respect to such figures can be incorporated by reference from one or more other figures described herein. Similarly, a description of a label shown in certain figures but not described with respect to such figures can use the description from other figures described herein.

Figure 1B:
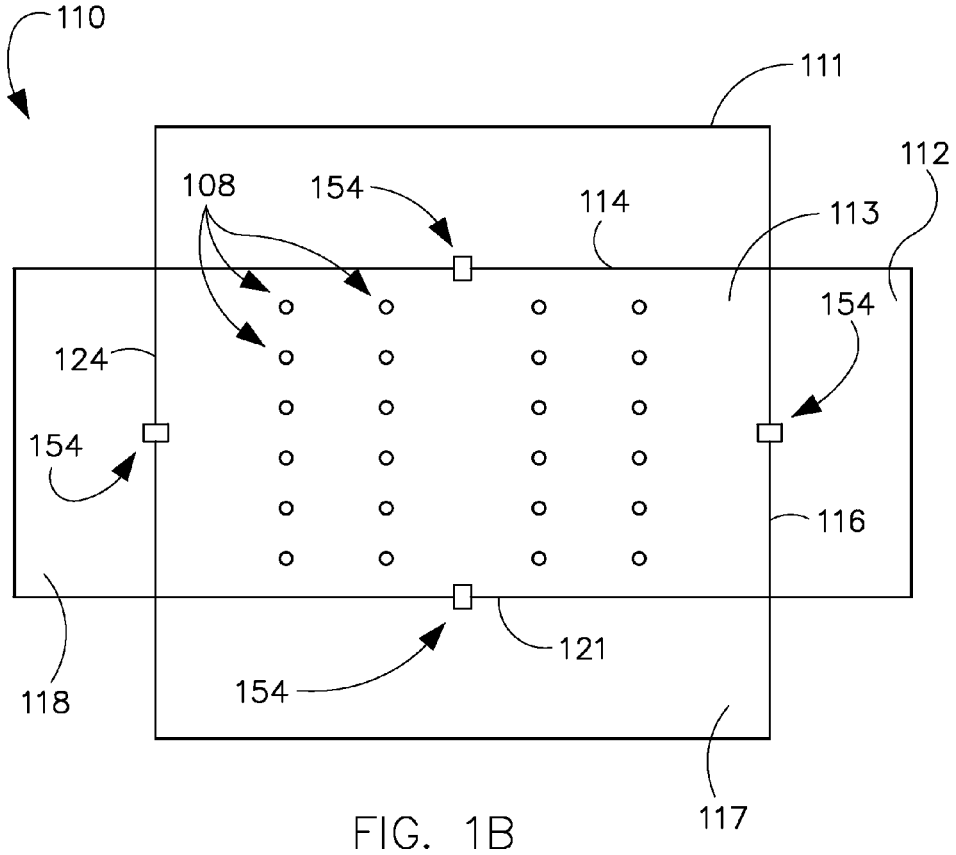

FIGS. 1A and 1B show various views of a housing 110 of a light fixture in accordance with certain example embodiments. Specifically, FIG. 1A shows a side perspective view of the example housing 110. FIG. 1B shows a bottom view of the example housing 110. In one or more example embodiments, one or more of the components shown in FIGS. 1A and 1B may be omitted, repeated, and/or substituted. Accordingly, example embodiments of housings (or portions thereof) should not be considered limited to the specific arrangements of components shown in FIGS. 1A and 1B.

Referring now to FIGS. 1A and 1B, the housing 110 can include one or more housing portions. In this case, there are five housing portions of the housing 110 in FIGS. 1A and 1B. Specifically, one housing portion is housing portion 113, which is rectangular in shape. There are also two side flaps (housing portion 112 and housing portion 118) a top flap (housing portion 111), and a bottom flap (housing portion 117). Each of these flaps (housing portion 112, housing portion 111, housing portion 117, housing portion 118) is movably coupled to one side of housing portion 113.

Each housing portion can have any of a number of shapes and/or sizes. For example, a housing portion can be flat, curved, angled, and/or have any other contour. As another example, a housing portion can be rectangular, triangular, octagonal, or any other shape. A housing portion of the housing 110 can be movably coupled to another housing portion in one or more of a number of ways. In other words, the coupling between housing portions of the housing 110 can be hinged, slidable, detachable, and/or any type of coupling that allows one housing portion to move relative to the coupled housing portion. To allow for the coupling between housing portions of the housing 110, each housing portion of the housing 110 can have one or more of a number of coupling features (e.g., coupling feature 114, coupling feature 116).

For example, housing portion 111 and housing portion 113 can be coupled to each other using coupling feature 114, which is disposed in part on housing portion 111 and in another part on housing portion 113. FIG. 1 also shows that coupling feature 116 is used to couple housing portion 112 to housing portion 113. Similarly, coupling feature 121 is used to couple housing portion 117 to housing portion 113, and coupling feature 124 is used to couple housing portion 118 to housing portion 113.

Such coupling features can include, but are not limited to, a portion of a hinge, an aperture, a slot, a tab, a detent, and a mating thread. Two housing portions of the housing 110 can be coupled to each other by the direct use of the coupling features disposed on each housing portion of the housing 110. In addition, or in the alternative, two housing portions of the housing 110 can be coupled to each other using one or more independent devices that interact with the coupling features disposed on the housing portions. Examples of such devices can include, but are not limited to, a pin, a hinge, a fastening device (e.g., screw, bolt), and a spring.

The one or more coupling features between adjacent housing portions of the housing 110 can allow one or more of those housing portions to move relative to the adjacent housing portion. Two or more housing portions of the housing 110 can be coupled using the same coupling feature. The movement of the housing portions of the housing 110 relative to each other can be rotational, spiral, linear, and/or some other type of movement. The movement of one housing portion relative to another housing portion can be limited within a range of motion (e.g., if rotational, between −90° and +90°; if linear, up to 4 inches) or unlimited.

In certain example embodiments, a housing portion of the housing 110 can have one or more component receiving features 108. Such component receiving features 108 can be used to receive, for example, one or more mounting platforms (e.g., mounting platform 240, mounting platform 250, as described below with respect to FIGS. 2A-2C), a control unit (e.g., control unit 291, as described below with respect to FIGS. 2A-2C), and/or a power source (e.g., power source 290, as described below with respect to FIGS. 2A-2C). A component receiving feature 108 of a housing portion of the housing 110 can include, but is not limited to, an aperture, a slot, a tab, a detent, and a mating thread. The component receiving feature 108 of the housing 110 can be coupled to a mounting platform, control unit, and/or power source by the direct use of the component receiving feature 108 disposed on each housing portion of the housing 110.

In addition, or in the alternative, a housing portion of the housing 110 can be coupled to a mounting platform, control unit, and/or power source using one or more independent devices that interact with the component receiving features 108 disposed on the housing portion of the housing 110. Examples of such devices can include, but are not limited to, a pin, a hinge, a fastening device (e.g., screw, bolt), and a spring. The component receiving features 108 can be oriented on the housing 110 in any of a number of ways. For example, the component receiving features 108 can be oriented to allow one or more mounting platforms to be coupled in multiple positions according to a user's needs. In such a case, one or more mounting platforms, one or more power sources, and/or one or more control units can be mounted lengthwise or widthwise relative to the housing 110.

One or more component receiving features 108 that mechanically couple the mounting platform, control unit, and/or power source to the housing 110 can also be used to transmit and/or provide for wiring to traverse therethrough for transmitting power and/or control signals between a power source and/or a control unit, and one or more light boards (e.g., light board 280, as described below with respect to FIGS. 2A-2C) that are mechanically coupled to one or more mounting platforms. For example, a mounting platform (coupled to a light board) and a power source can be coupled to the same component receiving feature 108, where a fastening device is used to both couple the mounting platform, the power source, and the housing portion 113 together, and to transmit power from the power source to the mounting platform. Each light board can be provided power and/or control signals from a power source and/or control unit in such a way that removing one light board does not affect the performance of the rest of the light boards for the light fixture.

The number of component receiving features 108 used in a housing 110 of a light fixture can vary. In this example, there are nine component receiving features 108 that form a 6×4 (six rows by four columns) grid. The component receiving features 108 can be distributed so that one or more other components (e.g., mounting platform, control unit, power source) can be positioned in one or more of a number of ways. Here, the component receiving features 108 are distributed substantially evenly along the length and width of the housing portion 113.

A housing portion of the housing 110 can be a flap (e.g., housing portion 111, housing portion 112) when such housing portion is lacking one or more features (e.g., a power source, a receiving feature) that are disposed on at least one other portion of the light fixture. A flap can be optional in a light fixture. In certain example embodiments, a flap is located on an outer perimeter of the housing 110 of the light fixture. A flap can be used to help shape and/or direct light emitted by one or more light sources disposed on a light board. A flap of the housing 110 can be made of one or more of a number of suitable materials, including but not limited to metal, glass (as with a mirror), and plastic. In some cases, one or more sides of a flap can be coated with a material that has reflective, refractive, and/or one or more other characteristics that allow the light emitted by a light source disposed on a light board to be altered and/or controlled.

Similarly, a housing portion (e.g., housing portion 113) that is not a flap can be made of one or more of a number of suitable materials, including but not limited to metal, glass (as with a mirror), ceramic, and plastic. In some cases, one or more sides of a housing portion can be coated with a material that has reflective, refractive, and/or one or more other characteristics that allow the light emitted by a light source disposed on a light board to be altered and/or controlled. In addition, when a power source and/or control unit is mounted on a housing portion, the housing portion can have one or more features (e.g., protrusions, fins) and/or properties (e.g., constructed of thermally conductive material) that allow for receiving and subsequently dissipating heat generated by the power source and/or control unit.

When two housing portions (e.g., housing portion 113, housing portion 111) are mechanically coupled to each other, one housing portion can be moved relative to the other housing portion in one or more of a number of ways. For example, a user can manually adjust one housing portion relative to the other housing portion. In such a case, the user can move one or more housing portions with or without the use of tools. As another example, one housing portion can move relative to another housing portion using a control unit (not shown) located on or proximate to the housing 110. In such a case, the control unit can be controlled by a user and/or based on the occurrence of some event (e.g., passage of time, detection of light, a temperature measurement, dimmer setting). In the latter case, the control unit can receive instructions to move one or more housing portions of the housing 110 based on software instructions executed on a hardware processor, an integrated circuit, and/or some other programmable device.

When one or more housing portions are coupled to one or more other housing portions, one or more control devices 154 can be used to move one housing portion relative to another housing portion. A control device 154 can be a mechanical coupling between one housing portion (e.g., housing portion 111) and another housing portion (e.g., housing portion 113) that allows for the positioning of one housing portion relative to another housing portion. For example, as shown in FIGS. 1A and 1B, the control devices 154 of the housing 110 allow each housing portion to rotate along the corresponding coupling feature to which the housing portions are coupled.

Figure 2A:
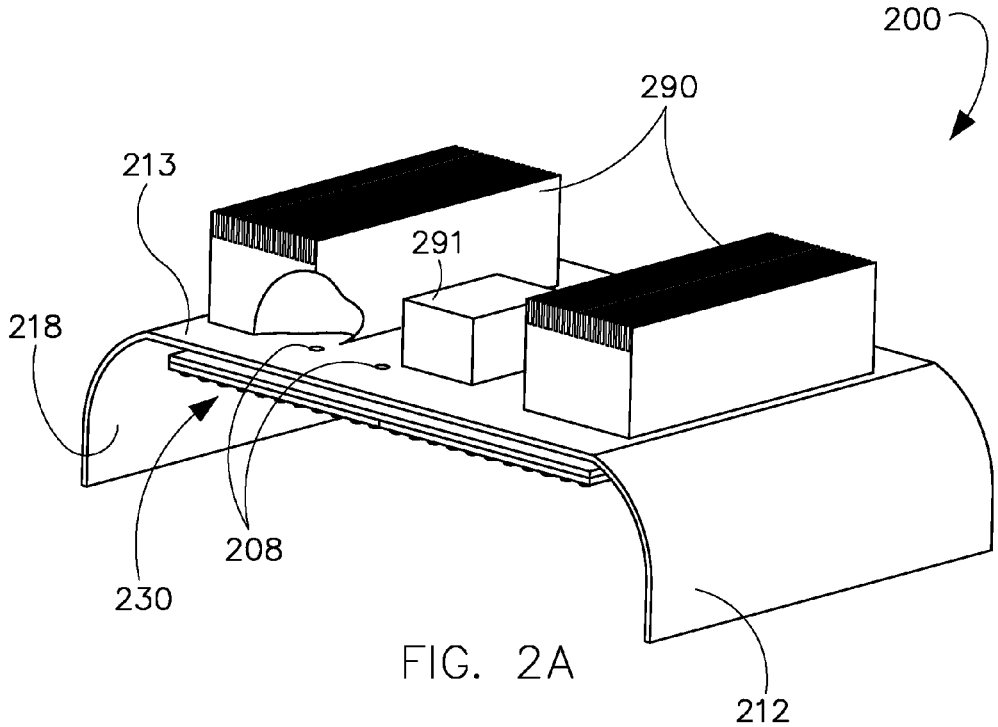
FIGS. 2A-2C show various views of an example light fixture in accordance with certain example embodiments.
Figure 2B:
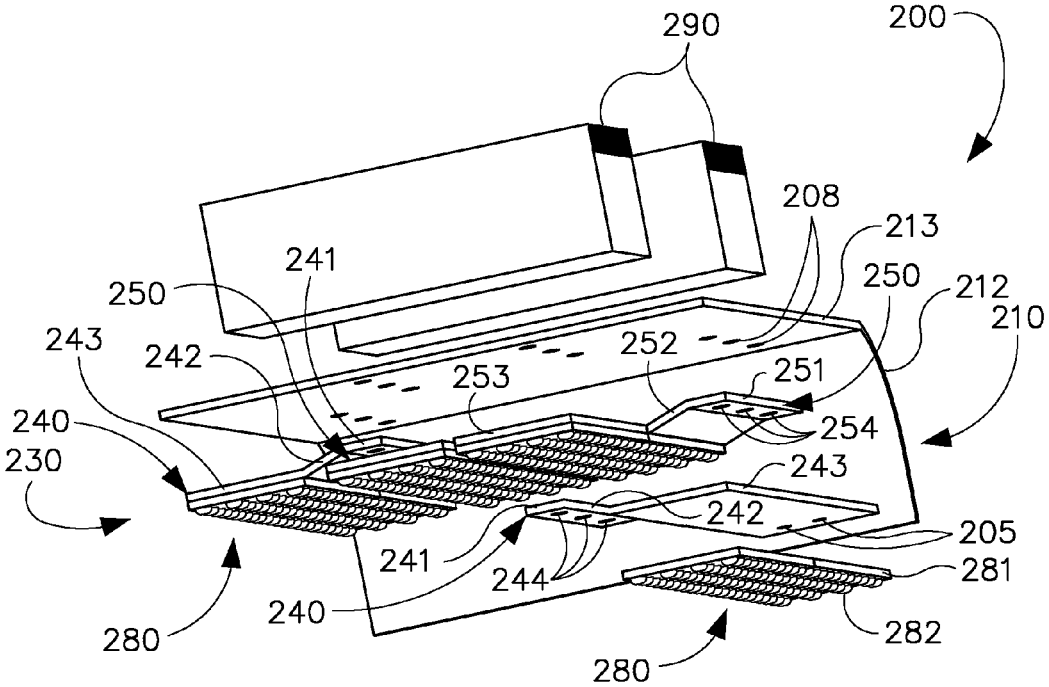

A control device 154 can be disposed at one or more points on a housing portion. When there are multiple control devices 154, each control device 154 can be the same as, or different than, the other control devices 154. A control device 154 can be mechanical or electro-mechanical. For example, when mechanical, the control device 154 can include one or more detents, an aperture, a fastening device, a clamp, a slot, and/or some other feature that allows a user to move and then fix the position of one housing portion relative to another housing portion. When the control device 154 is electro-mechanical, a motorized device, controlled by a control unit (as shown in FIGS. 2A and 2B below) can work independently of, or in conjunction with, the mechanical features listed above to allow a user to move and then fix the position of a housing portion relative to another housing poriton. In any case, one or more housing portions can be configured to be compatible with and/or include one or more control devices 154.

Similarly, movement of a mounting platform relative to a housing portion and/or a portion (e.g., fixture coupling portion, described below with respect to FIGS. 2A-2C) of a mounting platform relative to an adjacent portion (e.g., intermediate portion, described below with respect to FIGS. 2A-2C) of the mounting platform can be performed manually or electro-mechanically. When performed electro-mechanically, the control unit can work in conjunction with one or more local control devices (similar to the control devices 154 described above) disposed on or proximate to a housing portion and/or a mounting platform (or portion thereof).

Figure 2C:
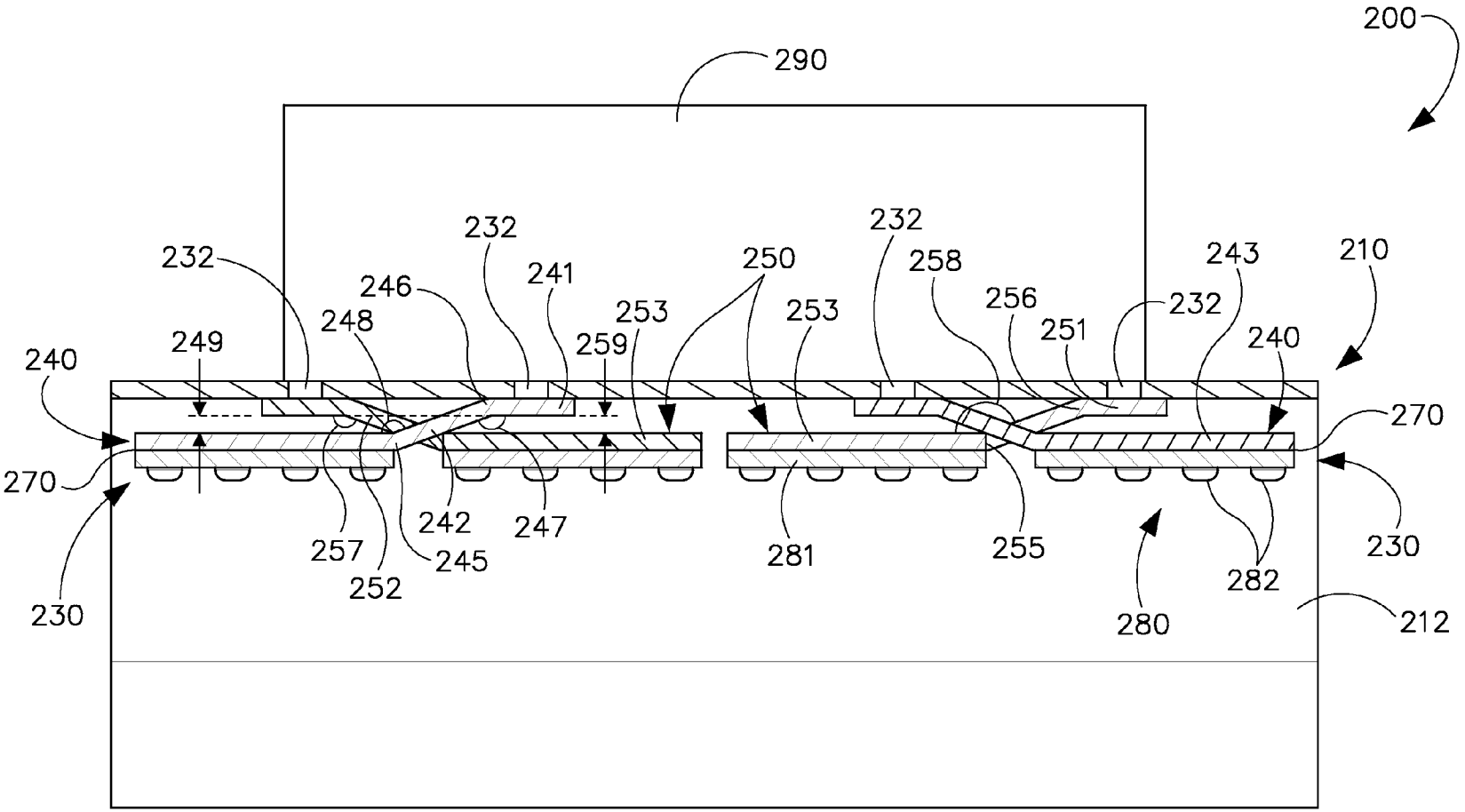

FIGS. 2A-2C show various views of an example light fixture 200 in accordance with certain example embodiments. Specifically, FIG. 2A shows a perspective view of the example light fixture 200. FIG. 2B shows an exploded view of an example light fixture 200. FIG. 2C shows a cross-sectional side view of the light fixture 200. In one or more example embodiments, one or more of the components shown in FIGS. 2A-2C may be omitted, repeated, and/or substituted. Accordingly, example embodiments of light fixtures (or portions thereof) should not be considered limited to the specific arrangements of components shown in FIGS. 2A-2C.

Referring now to FIGS. 1A-2C, the light fixture 200 of FIGS. 2A-2C can include a housing 210, one or more power sources 290, a network 230 of mounting platforms (e.g., mounting platform 240, mounting platform 250), and a number of light boards 280. The housing 210 of FIGS. 2A-2C are substantially the same as the housing 110 of FIGS. 1A and 1B, except as described below. The description for any component (e.g., housing portion 213, control device 254) of FIGS. 2A-2C not provided below can be considered substantially the same as the corresponding component (e.g., housing portion 113, control device 154) described above with respect to FIGS. 1A and 1B. The numbering scheme for the components of FIGS. 2A-2C parallel the numbering scheme for the components of FIGS. 1A and 1B in that each component is a three digit number, where similar components between the housing 210 of FIGS. 2A-2C and the housing 110 have the identical last two digits.

In describing mounting platforms for FIGS. 2A-2C, reference is made to mounting platform 240. Mounting platform 250 and its components parallel the numbering scheme for the mounting platform 240 and its components in that each component is a three digit number, where similar components between the mounting platforms have the identical last two digits. However, the size, shape, and/or orientation of the one or more portions of the mounting platform 250 can be different than the corresponding portion of the mounting platform 240. A network 230 of mounting platforms is where one or more mounting platforms is used in a light fixture 200. Some or all portions of a mounting platform can be made of one or more of a number of electrically and/or thermally conductive materials.

Each mounting platform 240 of FIGS. 2A-2C can include one or more portions. For example, the mounting platforms of FIGS. 2A-2C can include a fixture coupling portion 241, a light board coupling portion 243, and an intermediate portion 242. The fixture coupling portion 241 can include one or more fixture receiving features 244. The one or more fixture receiving features 244 can be configured to couple to one or more receiving features 208 of the housing 210. Each fixture receiving feature 244 can include, but is not limited to, an aperture, a slot, a tab, a detent, and a mating thread. The fixture receiving feature 244 of the mounting platform 240 can be coupled to a housing portion (e.g., housing portion 213), a control unit 291, and/or a power source 290 by the direct use of the fixture receiving feature 244 disposed on each fixture coupling portion 241 of the mounting platform 240. In addition, or in the alternative, a fixture coupling portion 241 of a mounting platform 240 can be coupled to a housing portion, a control unit 291, and/or a power source 290 using one or more coupling devices 232 that interact with the fixture receiving features 244 disposed on the housing portion of the housing 110. Examples of such coupling devices 232 can include, but are not limited to, a pin, a hinge, a fastening device (e.g., screw, bolt), a control device (substantially similar to the control device 154 described above or the control devices (e.g., control device 245, control device 246) described below) and a spring.

One or more fixture receiving features 244 that mechanically couple a housing portion, a control unit 291, and/or power source 290 to the mounting platform 240 can also be used to transmit and/or provide for wiring to traverse therethrough for transmitting power and/or control signals between a power source 290 and/or a control unit 291, and one or more light boards (e.g., light board 280) that are mechanically coupled to one or more mounting platforms 240. Each light board 280 can be provided power and/or control signals from a power source 290 and/or control unit 291 in such a way that removing one light board 280 does not affect the performance of the rest of the light boards 280 for the light fixture 200.

Specifically, one or more light boards 280 can be mechanically coupled to a light board coupling portion 243 of a mounting platform 240. The light board coupling portion 243 of the mounting platform 240 can include one or more light board coupling features 205, which are used to couple the light board coupling portion 243 to one or more light boards 280. Each light board coupling feature 205 can include, but is not limited to, an aperture, a slot, a tab, a portion of an electrical connector, a detent, a control device (similar to control device 154 described above with respect to FIGS. 1A and 1B), and a mating thread. The light board coupling feature 205 of the light board coupling portion 243 of the mounting platform 240 can be coupled to a light board 280 by the direct use of the light board coupling feature 205 disposed on each light board coupling portion 243 of the mounting platform 240.

In addition, or in the alternative, a light board coupling portion 243 of a mounting platform 240 can be coupled to a light board 280 using one or more independent devices that interact with the light board coupling features 205 and a corresponding feature of the light board 280. Examples of such devices can include, but are not limited to, a pin, a hinge, a fastening device (e.g., screw, bolt), and a spring. One or more light board coupling features 205 that mechanically couple a light board 280 to the mounting platform 240 can also be used to transmit and/or provide for wiring to traverse therethrough for transmitting power and/or control signals between a power source 290 and/or a control unit 291, and one or more light boards 280 that are mechanically coupled to one or more mounting platforms 240.

The position of a light board 280 relative to a light board coupling portion 243 can be changed. For example, a light board 280 can be rotated about an axis formed by a light board coupling feature 205 disposed on a light board coupling portion 243. The position of a light board 280 relative to mounting platform 240 can be changed in one or more of a number of ways. For example, a user can manually adjust a light board 280 relative to a mounting platform 240. In such a case, the user can move the light board 280 with or without the use of tools. As another example, a light board 280 can move relative to the mounting platform 240 using a control unit 291 located on or proximate to the housing 210 and operatively coupled to one or more control devices, where the control device is, or is incorporated with, one or more light board coupling features 205.

In such a case, the control unit 291 can be controlled by a user and/or based on the occurrence of some event (e.g., passage of time, detection of light, a temperature measurement, dimmer level of a light module). In the latter case, the control unit 291 can receive instructions to move one or more portions of the mounting platform 240 and/or the light board 280 based on software instructions executed on a hardware processor, an integrated circuit, and/or some other programmable device. The control unit 291 used to move a light board 280 can be the same as, or different than, the light control unit 291 described above with respect to moving a housing portion of the housing 210.

Each light board 280 can include one or more light sources 282 mounted on a board platform 281. A light board 280 can include one or more optional diffusers (e.g., a lenses) (not shown) made of one or more of a number of suitable materials (e.g., glass, plastic). Alternatively, a light board 280 can have no diffuser. The light source 282 can be any type of light source using any type of lighting technology, as described above. When a light board 280 includes multiple light sources 282, each light source 282 can be the same (e.g., color, shape, size, type) as, or different than, the other light sources 282. The board platform 281 can have electrical features (e.g., internal wiring) that allow power to be transferred from the mounting platform 240 to the light sources 282.

The board platform 281 can be made of one or more of a number of thermally conductive materials in thermal communication with the light source 282 so that heat generated by the light source 282 is received and dissipated by the thermally conductive material of the board platform 281. Similarly, some or all of the mounting platform 240 can be made of one or more of a number of thermally conductive materials in thermal communication with the board platform 281 so that heat contained in the board platform 281 is received and dissipated by the thermally conductive material of the mounting platform 240. In some cases, a material 270 can be disposed between the board platform 281 and the light board coupling portion 243. Such a material 270 can be used to promote electrical conductivity, promote thermal conductivity, reduce or prevent ingress of external materials (e.g., dust, moisture), and/or create some other desired result.

In certain example embodiments, the intermediate portion 242 of the mounting platform 240 couples to, and is positioned between, the fixture coupling portion 241 and the light board coupling portion 243. The intermediate portion 242 can form an angle with the fixture coupling portion 241 and/or the light board coupling portion 243 For example, in this case, the intermediate portion 242 and the fixture coupling portion 241 form angle 247, and the intermediate portion 242 and the light board coupling portion 243 form angle 248. The angle 247 and/or the angle 248 can be fixed or adjustable. The angle 247 and the angle 248 can be acute, obtuse, or 90°. For a particular mounting platform 240, the angle 247 can be substantially the same as, or different than, the angle 248. When the angle 247 and/or the angle 248 is adjustable, the adjustment can be made using the control unit 291.

Where the intermediate portion 242 is coupled to the fixture coupling portion 241, one or more control devices 246 can be used to move the intermediate portion 242 relative to the fixture coupling portion 241. Similarly, where the intermediate portion 242 is coupled to the light board coupling portion 243, one or more control devices 245 can be used to move the light board coupling portion 243 relative to the intermediate portion 242. The control device 246 can be used to adjust the angle 247, and the control device 245 can be used to adjust the angle 248. The control devices 245 and the control devices 246 can be substantially similar to the control devices 154 described above with respect to FIGS. 1A and 1B.

Depending on the angle 247 and the angle 248, the fixture coupling portion 241 can be substantially parallel to, or anti-parallel with respect to, the light board coupling portion 243. As shown in FIG. 2C, the angle 247 and the angle 248 are substantially the same, and so the fixture coupling portion 241 is substantially parallel to the light board coupling portion 243. Further, depending on the length (the distance between the fixture coupling portion 241 and the light board coupling portion 243) of the intermediate portion 242, the angle 247, and the angle 248, there can be a distance 249 that separates the light board coupling portion 243 from the fixture coupling portion 241 that is normal (perpendicular) to the planes formed by the light board coupling portion 243 from the fixture coupling portion 241.

One or more portions of a mounting platform 240 can be fixedly or removably coupled to one or more other portions of the mounting platform 240 using one or more of a number of coupling methods, including but not limited to welding, mating threads, compression fittings, slots, tabs, and detents. In certain example embodiments, some or all of the mounting platform 240 is a single piece, as from a mold or casting process. The mounting platform 240 can be made from one or more of a number of a number of suitable materials, including but not limited to metal, plastic, rubber, and ceramic.

A control device 246 can be disposed at one or more points at or near the junction between the intermediate portion 242 and the fixture coupling portion 241. Similarly, a control device 245 can be disposed at one or more points at or near the junction between the intermediate portion 242 and the light board coupling portion 243. When there are multiple control devices 245 and/or control devices 246, each control device 245 and/or control device 246 can be the same as, or different than, the other control devices. A control device 245 and/or a control device 246 can be mechanical or electro-mechanical.

For example, when mechanical, a control device 245 and/or a control device 246 can include one or more detents, an aperture, a fastening device, a clamp, a slot, and/or some other feature that allows a user to move and then fix the position of one housing portion relative to another housing portion. When a control device 245 and/or a control device 246 is electro-mechanical, a motorized device, controlled by a control unit 291, can work independently of, or in conjunction with, the mechanical features listed above to allow a user to move and then fix the position of angle 247 and/or angle 248. In any case, one or more portions of a mounting platform can be configured to be compatible with and/or include one or more control devices 245 and/or control devices 246.

In certain example embodiments, there are one or more power sources 290 included in the light fixture 200. Each power source 290 can be affixed to some part of the housing 210. For example, as shown in FIGS. 2A and 2B, a power source 290 can be coupled to a top surface of a housing portion (e.g., housing portion 213). Each power source 290 can include one or more of a number of components (e.g., transformer, resistor, capacitor, integrated circuit) that can be discrete components, components integrated with a circuit board, and/or functions performed by components that are programmed into a hardware processor. The power source 290 receives power and/or control information from a source (via a switch or control device communicably coupled to the power source 290), converts the power and/or control to a corresponding signal (e.g., voltage, current), and sends the corresponding signal to the one or more light boards 280 to control the operational characteristics of the light boards 280.

When the power source 290 is mounted on the top surface of a housing portion or at some other location, the power source 290 can be enclosed so that none of the components of the power source 290 is exposed. In certain example embodiments, the power source 290 is located remotely from the remainder of the light fixture 200. The power source 290 can transmit power and/or control with the one or more light boards 280 using wired and/or wireless technology.

In certain example embodiments, the light fixture 200 also includes a control unit 291 that can be used to control one or more of the control devices (e.g., control device 245, control device 246). In such a case, the control devices coupled to the control unit 291 can be electro-mechanical. The control unit 291 can be used to change or set a position of one component of the light fixture 200 relative to another component of the light fixture 200. For example, the control unit 291 can be used to adjust the angle 247 between the fixture coupling portion 241 and the intermediate portion 242 of a mounting platform 240. As another example, the control unit 291 can be used to adjust the position of one housing portion (e.g., housing portion 212) relative to another housing portion (e.g., housing portion 213). The control unit 291 can be electrically coupled to, or decoupled from, a power source 290. In certain example embodiments, the control unit 291 can be a manual operation performed by a user to one or more components of the light fixture 200.

Figure 3:
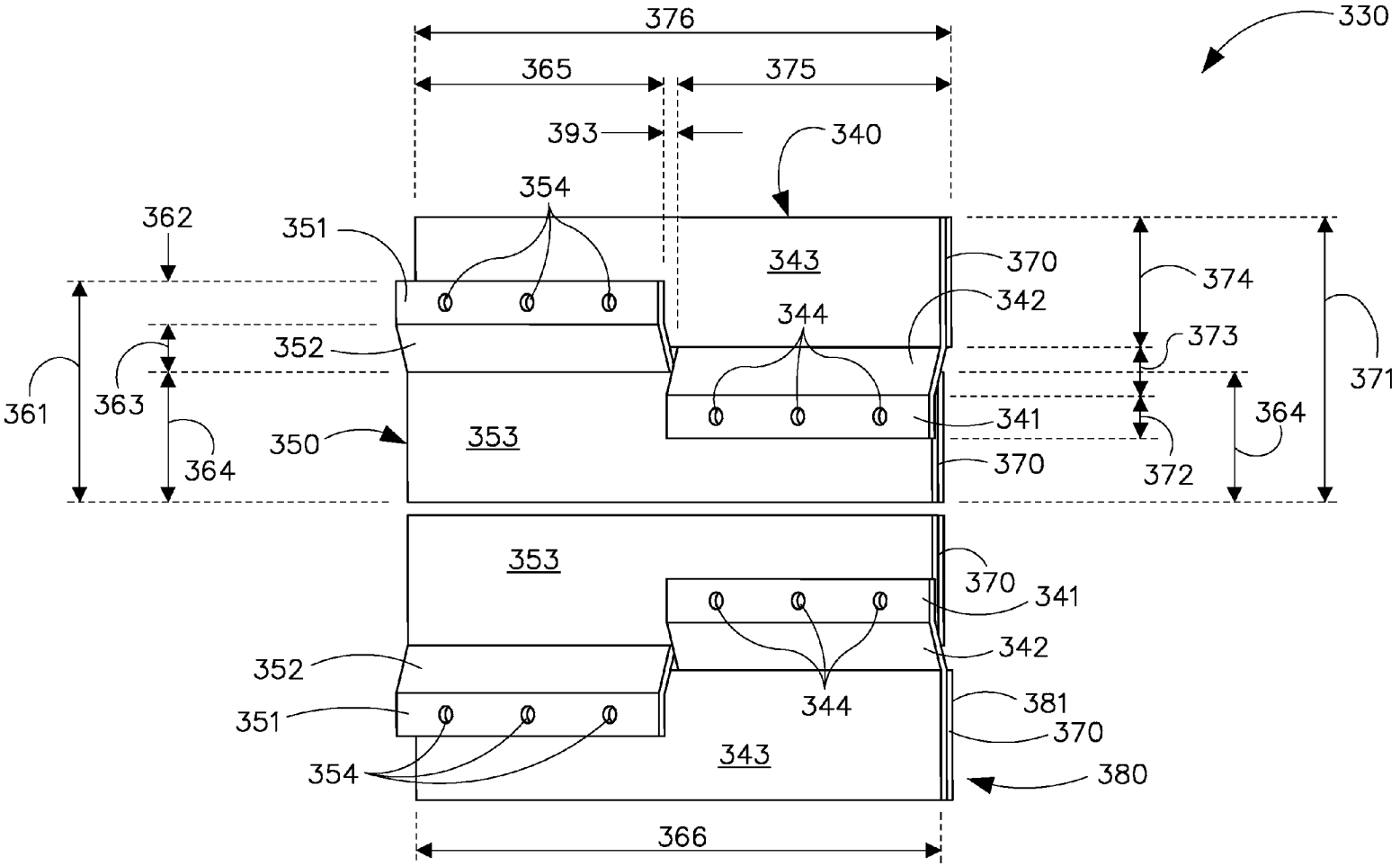
FIG. 3 shows a perspective view of a network of mounting platforms in accordance with certain example embodiments.

FIG. 3 shows a perspective view of a network 330 of mounting platforms in accordance with certain example embodiments. In one or more example embodiments, one or more of the components shown in FIG. 3 may be omitted, repeated, and/or substituted. Accordingly, example embodiments of a network of mounting platforms (or portions thereof) should not be considered limited to the specific arrangements of components shown in FIG. 3.

Referring to FIGS. 1A-3, the network 330 of FIG. 3 can include one or more mounting platforms. For example, in this case, the network 330 includes two mounting platforms 340 and two mounting platforms 350. The mounting platforms 340 and the mounting platforms 350 of FIG. 3 are substantially the same as the mounting platforms 240 and the mounting platforms 250 of FIGS. 2A-2C. The description for any component (e.g., light board coupling portion 343, fixture coupling portion 351) of FIG. 3 not provided below can be considered substantially the same as the corresponding component (e.g., light board coupling portion 243, fixture coupling portion 251) described above with respect to FIGS. 1A-2C. The numbering scheme for the components of FIG. 3 parallel the numbering scheme for the components of FIGS. 1A-2C in that each component is a three digit number, where similar components between the mounting platforms of FIG. 3 and the mounting platforms of FIGS. 1A-2C have the identical last two digits.

The network 330 of mounting platforms shown in FIG. 3 show one embodiment in which the mounting platforms can be arranged. In this case, each mounting platform 340 overlaps with and is rotated 180° relative to each mounting platform 350. Specifically, the fixture coupling portion 341 of the mounting platform 340 overlaps a portion of the light board coupling portion 353 of the mounting platform 350, and the fixture coupling portion 351 of the mounting platform 350 overlaps a portion of the light board coupling portion 343 of the mounting platform 340. In addition, the intermediate portion 352 of the mounting platform 350 is adjacent to, but sloped in the opposite direction from, the intermediate portion 342 of the mounting platform 340.

In certain example embodiments, the width 365 of the fixture coupling portion 351 (as well as, in this example, the intermediate portion 352) is less than the width of the light board coupling portion 343 and the light board coupling portion 353. Similarly, the width 375 of the fixture coupling portion 341 (as well as, in this example, the intermediate portion 342) is less than the width of the light board coupling portion 343 and the light board coupling portion 353. A gap 393 can exist between the intermediate portion 342 and the intermediate portion 352 when the mounting platform 340 and the mounting platform 350 are interlaced with each other as shown in FIG. 3.

For the mounting platform 350, the length 362 of the fixture coupling portion 351 can be less than the length 363 of the intermediate portion 352, which can be less than the length 364 of the light board coupling portion 353. Similarly, for the mounting platform 340, the length 372 of the fixture coupling portion 341 can be less than the length 373 of the intermediate portion 342, which can be less than the length 374 of the light board coupling portion 343. The length 374 and/or the width 376 of the light board mounting portion 343 can be substantially the same as, or different than, the length and width of a light board 380 affixed thereto. In addition, or in the alternative, the shape of the light board mounting portion 343 can be substantially the same as, or different than, the shape of the light board 380 affixed thereto. Similarly, the length 364, the width 366, and/or the shape of the light board mounting board 353 can be substantially the same as or different than the length, width, and/or shape of a light board 380 affixed thereto.

When the network 330 is assembled, such as shown in FIG. 3, the fixture receiving features 344 of the mounting platforms 340 and the fixture receiving features 354 of the mounting platforms 350 can be aligned with corresponding component receiving features 108. As stated above, the network 330 can have multiple positions relative to one or more housing portions of the housing 110, depending on how the component receiving features 108 are sized and/or oriented on the one or more housing portions of the housing 110 relative to the fixture receiving features 344 of the mounting platforms 340 and the fixture receiving features 354 of the mounting platforms 350.

In certain example embodiments, one or more of the dimensions (e.g., the width of the light board coupling portion 343, the thickness of the fixture coupling portion 341) of the mounting platform 340 can be substantially the same as and/or different than the corresponding dimensions of the mounting platform 350. In this example, all dimensions of the mounting platform 340 are substantially the same as the corresponding dimensions of the mounting platform 350. Similarly, the location, size, and/or configuration of the fixture receiving features 344 and the light board receiving features (hidden from view) disposed on the mounting platform 340 can be substantially the same as, or different than, the corresponding location, size, and/or configuration of the fixture receiving features 354 and the light board receiving features (hidden from view by the light boards 380) disposed on the mounting platform 350. In this case, the location, size, and/or configuration of the fixture receiving features 344 (in this case, apertures) and the light board receiving features disposed on the mounting platform 340 are substantially the same as the corresponding location, size, and/or configuration of the fixture receiving features 354 and the light board receiving features disposed on the mounting platform 350.

In addition or in the alternative, in certain example embodiments, the fixture receiving features 344 can be used to couple the associated mounting platform 340 with fixture receiving features of another adjacent mounting platform. In such a case, the coupling between mounting platforms through the fixture receiving features can be mechanical as well as electrical. When this occurs, the mounting platforms can be expanded (extended) in one or more directions independent of the component receiving features on a housing portion of the housing 310.

Figure 4:
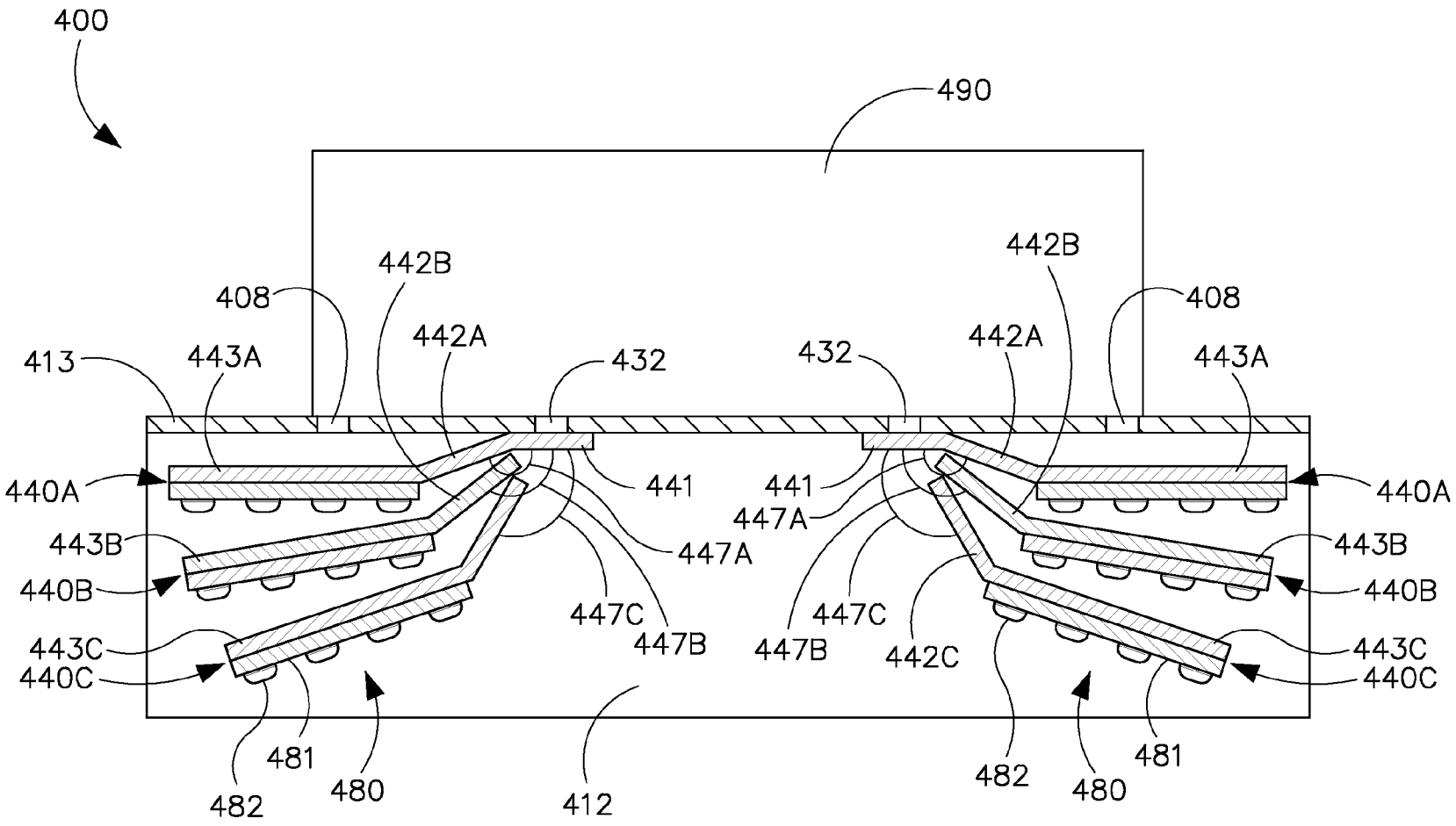
FIG. 4 shows a cross-sectional side view of various embodiments of a light fixture using mounting platforms in accordance with certain example embodiments.
Figure 5:
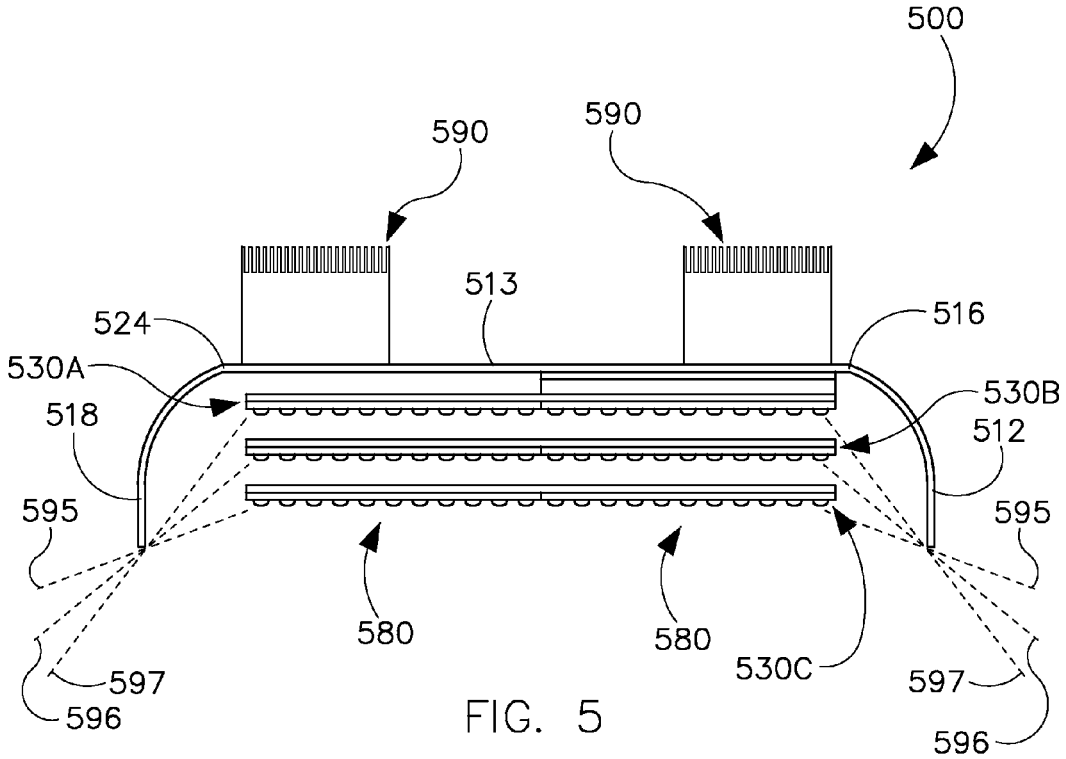
FIG. 5 shows a side view of a light fixture with various mounting platforms in accordance with certain example embodiments.
Figure 6:
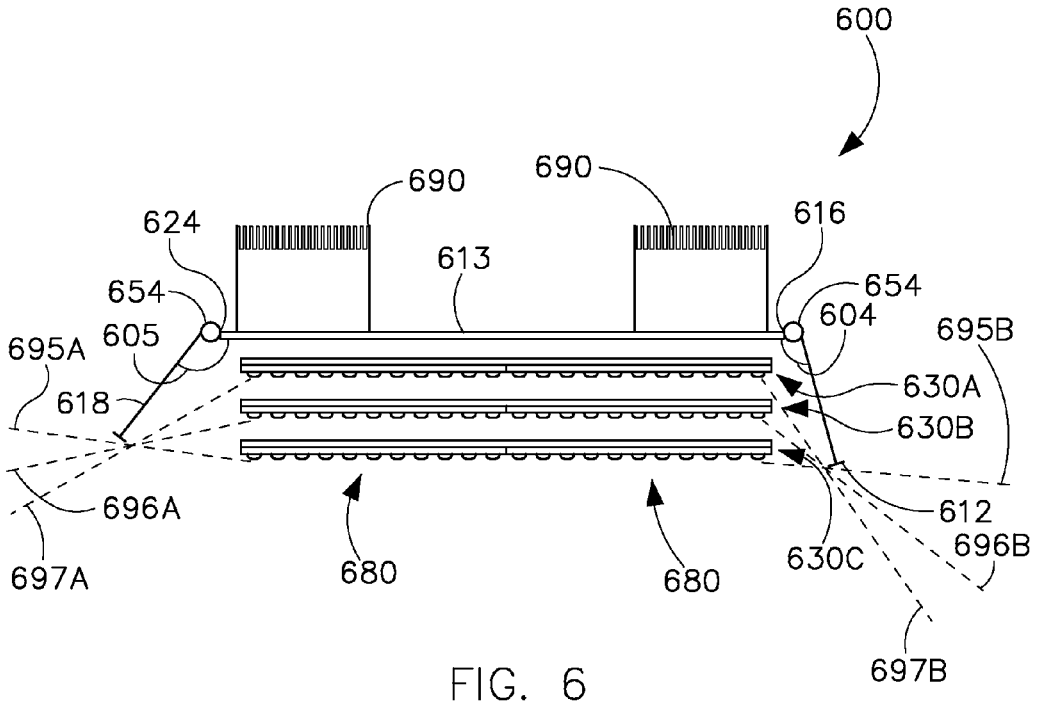
FIG. 6 shows a side view of a light fixture with various mounting platforms in accordance with certain example embodiments.

FIGS. 4-6 shows cross-sectional side views of various light fixtures using mounting platforms in accordance with certain example embodiments. Specifically, FIG. 4 shows a cross-sectional side view of various embodiments of a light fixture 400 using mounting platforms in accordance with certain example embodiments. FIG. 5 shows a side view of various embodiments of a light fixture 500 with mounting platforms in accordance with certain example embodiments. FIG. 6 shows a side view of various embodiments of a light fixture 600 with mounting platforms in accordance with certain example embodiments. In one or more example embodiments, one or more of the components shown in FIGS. 4-6 may be omitted, repeated, and/or substituted. Accordingly, example embodiments of light fixtures using mounting platforms (or portions thereof) should not be considered limited to the specific arrangements of components shown in FIGS. 4-6.

Referring to FIGS. 1A-6, the light fixtures of FIGS. 4-6 can include one or more mounting platforms. The light fixtures (and their various components) of FIGS. 4-6 are substantially the same as the light fixtures (and their various components) of FIGS. 1A-3, except as described below. The description for any component of FIGS. 4-6 not provided below can be considered substantially the same as the corresponding component described above with respect to FIGS. 1A-3. The numbering scheme for the components of FIGS. 4-6 parallel the numbering scheme for the components of FIGS. 1A-3 in that each component is a three digit number, where similar components between the light fixtures (and their various components) of FIGS. 4-6 and the light fixtures (and their various components) of FIGS. 1A-3 have the identical last two digits.

The light fixture 400 shown in FIG. 4 is similar to the light fixture 200 shown in FIG. 2C, except that the mounting platforms 250 have been removed. As a result, the component receiving features 408 that were used to receive and couple to the mounting platforms 250 are open. The component receiving features 408 can be used to mechanically couple the housing 410 to a power source 490. Alternatively, the component receiving features 408 can be capped or covered so that dirt and other elements cannot traverse one side of the housing portion 413 in which the component receiving features 408 are disposed to the other. As yet another alternative, the component receiving features 408 can be left uncovered.

The light fixture 400 of FIG. 4 shows three different angle 447 for each of the mounting platforms 440. Specifically, each of mounting platforms 440A has angle 447A between its light fixture coupling portion 441 and its intermediate portion 442A. The angle 447A is substantially similar to angle 247 shown in FIG. 2C. Each of mounting platforms 440B in FIG. 4 has angle 447B between its light fixture coupling portion 441 and its intermediate portion 442B. Also, each of mounting platforms 440C has angle 447C between its light fixture coupling portion 441 and its intermediate portion 442C. In this case, angle 447C is smaller than angle 447B, which is smaller than angle 447A. Angle 447A, angle 447B, and angle 447C can be discrete angles between the light fixture coupling portion 441 and the intermediate portion 442. As another possibility, angle 447A, angle 447B, and angle 447C can be part of a continuous range (e.g., between 0° and 180°) of angles between the light fixture coupling portion 441 and the intermediate portion 442.

By adjusting angle 447 (and/or angle 448 between the intermediate portion 442 and the light board coupling portion 443), the direction of the light emitted by the light sources 482 mounted on the board platform 481 of a light board 480 can vary. For example, in this case, by having the mounting platforms 440A set at angle 447A, the light emitted by the light boards 480 are more widely distributed compared to light emitted by the light boards 480 when the mounting platforms 440C are set at angle 447C. As stated previously, the angle 447 can be adjusted manually or automatically using one or more control devices.

The light fixture 500 shown in FIG. 5 shows three different vertical positions of a network 530 of mounting platforms (which includes a number of light boards 580) relative to the housing portion 513 of the housing 510. In this example, the light boards 580 are substantially parallel to the housing portion 513, but the one or more of the light boards 580 can be positioned at some other angle relative to the housing portion 513. Network 530A is positioned substantially close to the bottom surface of the housing portion 513, similar to what is shown, for example, in FIG. 2C. Network 530B is positioned further away from the housing portion 513 than network 530A, and network 530C is positioned further away from the housing portion 513 than network 530B.

The light emitted by the light sources 582 mounted on the light boards 580 can be controlled in one or more of a number of ways. As one example, the distance between the light boards 580 and the housing portion 513 can be adjusted in one or more of a number of ways. For example, by making angle 547 and/or angle 548 close to 90°, the light boards 580 can be positioned further away from the housing portion 513. As another example, by positioning spacers between the housing portion 513 and the fixture coupling portion 541 of a mounting platform 540, the entire mounting platform can be placed further away from the housing portion 513 while remaining mechanically (and, in some cases, electrically) coupled to the housing portion 513, a power source 590, a control unit, and/or some other component of the light fixture 500.

The light emitted by the light sources 582 can also be controlled by the shape and size of one or more housing members. For example, as shown in FIG. 5, housing portion 512 and housing portion 518, each mounted on opposite ends of housing portion 513, each has a curved shape from coupling feature 516 and coupling feature 524, respectively, which then becomes a straight segment that extends downward, away from and substantially perpendicular to the housing portion 513. The extent to which the housing portion 512 and the housing portion 518 extend downward relative to the light boards 580 can control the light emitted by the light sources 582. By adjusting the distance between the light boards and the housing portion 513, as described above, in combination with the shape and size of the housing portion 512 and the housing portion 518, the light emitted by the light sources 582 can be further controlled.

In this example, when the light boards 580 are part of network 530A and are positioned relatively close to the housing portion 513, the light emitted by the light sources 582 of the light boards 580 is bounded by light path 597, which is defined by the distal end of housing portion 512 and housing portion 518. When the light boards 580 are part of network 530B and are positioned further away from the housing portion 513, the light emitted by the light sources 582 of the light boards 580 is bounded by light path 596, which is defined by the distal end of housing portion 512 and housing portion 518. Finally, when the light boards 580 are part of network 530C and are positioned still further away from the housing portion 513, the light emitted by the light sources 582 of the light boards 580 is bounded by light path 595, which is defined by the distal end of housing portion 512 and housing portion 518. Light path 595 is broader than light path 596, which is broader than light path 597.

The light fixture 600 shown in FIG. 6 is substantially the same as the light fixture 500 of FIG. 5 except that the housing portion 612 and the housing portion 618 are adjustable with respect to the housing portion 613. One or more control devices 654 can be used to adjust the position of the housing portion 612 and the housing portion 618 are adjustable with respect to the housing portion 613. By adjusting the position of the housing portion 612 and/or the housing portion 618, the light emitted by the light sources 682 of the light boards 680 can be further controlled.

In this example, the angle 604 formed between housing portion 612 and housing portion 613 is smaller than the angle 605 formed between housing portion 618 and housing portion 613. When the light boards 680 are part of network 630A and are positioned relatively close to the housing portion 613, the light emitted by the light sources 682 of the light boards 680 is bounded on the left side by light path 697A, which is defined by the distal end of housing portion 618, and on the right side by light path 697B, which is defined by the distal end of housing portion 612. When the light boards 680 are part of network 630B and are positioned further away from the housing portion 613, the light emitted by the light sources 682 of the light boards 680 is bounded on the left side by light path 696A, which is defined by the distal end of housing portion 618, and on the right side by light path 696B, which is defined by the distal end of housing portion 612. Finally, when the light boards 680 are part of network 630C and are positioned still further away from the housing portion 613, the light emitted by the light sources 682 of the light boards 680 is bounded on the left side by light path 695A, which is defined by the distal end of housing portion 618, and on the right side by light path 695B, which is defined by the distal end of housing portion 612.

In one or more example embodiments, example light fixtures described herein allow for mechanical, electrical, and/or optical expansion of the light boards. In addition, or in the alternative, example light boards can be adjusted with respect to the housing, one or more other light boards, the distance and/or orientation between the housing, and/or the orientation of the light modules. Such adjustments can be made manually by a user or using a control unit. Thus, example light boards allow for adaptability based on changing conditions, changing locations, and/or changing needs. Example light fixtures using light boards can comply with one or more of a number of standards and/or regulations, allowing for use in various applications and/or various orientations of the light fixture in such uses.

Accordingly, many modifications and other embodiments set forth herein will come to mind to one skilled in the art to which light fixtures having example light boards pertain having the benefit of the teachings presented in the foregoing descriptions and the associated drawings. Therefore, it is to be understood that light fixtures having example light boards are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A mounting platform for a light board, the mounting platform comprising:

a fixture coupling portion comprising at least one fixture receiving feature, wherein the at least one fixture receiving feature comprises at least one first aperture and is configured to couple to a light fixture;

a light board coupling portion comprising at least one light board coupling feature, wherein the at least one light board coupling feature comprises at least one second aperture and is configured to couple to at least one light board; and an intermediate portion movably coupled to and positioned between the fixture coupling portion and the light board coupling portion, wherein the intermediate portion forms an adjustable first angle of a range of first angles with the fixture coupling portion, wherein the first intermediate portion forms an adjustable second angle of a range of second angles with the light board coupling portion, wherein the adjustable first angle and the adjustable second angle are adjustable independently of each other.

2. The mounting platform of claim 1, wherein the fixture coupling portion comprises electrically conductive material and is configured to be electrically coupled to a power source using the fixture coupling portion.

3. The mounting platform of claim 2, wherein the intermediate portion and the light board coupling portion are electrically conductive and are configured to conduct electricity from the fixture coupling portion to the at least one light board.

4. The mounting platform of claim 1, wherein the fixture coupling portion has a first width that is less than a second width of the light board coupling portion.

5. The mounting platform of claim 4, wherein the first width is substantially the same as a third width of the intermediate portion.

6. A light fixture, comprising:

at least one first light board;

a housing comprising a first housing portion, wherein the first housing portion comprises at least one first component receiving feature, wherein the at least one first component receiving feature comprises at least one first aperture; and a first mounting platform comprising:

a first fixture coupling portion comprising at least one first housing receiving feature, wherein the at least one first housing receiving feature comprises at least one second aperture and is coupled to the at least one first component receiving feature of the first housing portion;

a first light board coupling portion comprising at least one first light board coupling feature, wherein the at least one first light board coupling feature comprises at least one third aperture and is coupled to the at least one first light board; and a first intermediate portion movably coupled to and positioned between the first fixture coupling portion and the first light board coupling portion, wherein the first intermediate portion forms an adjustable first angle of a range of first angles with the first fixture coupling portion, wherein the first intermediate portion forms an adjustable second angle of a range of second angles with the first light board coupling portion, wherein the at least one first light board avoids contact with at least one second light board located adjacent to the at least one first light board when the first intermediate portion and the first fixture coupling portion form any adjustable first angle within the range of first angles and when the first intermediate portion and the first light board coupling portion form any adjustable second angle within the range of second angles.

7. The light fixture of claim 6, further comprising:

a second mounting platform comprising:

a second fixture coupling portion comprising at least one second housing receiving feature, wherein the at least one second housing receiving feature is coupled to at least one second component receiving feature of the first housing portion;

a second light board coupling portion comprising at least one second light board coupling feature, wherein the at least one second light board coupling feature is coupled to the at least one second light board; and a second intermediate portion coupled to and positioned between the second fixture coupling portion and the second light board coupling portion, wherein the second intermediate portion forms an adjustable third angle of a plurality of adjustable third angles with the second fixture coupling portion, and wherein the second intermediate portion forms an adjustable fourth angle of a plurality of adjustable fourth angles with the second light board coupling portion, wherein the at least one second light board is coupled to the at least one second light board coupling feature.

8. The light fixture of claim 7, wherein the first fixture coupling portion has a first width, and wherein the first light board coupling portion has a second width.

9. The light fixture of claim 8, wherein the second fixture coupling portion has a third width, and wherein the second light board coupling portion has a fourth width.

10. The light fixture of claim 9, wherein the first width added to the third width are no greater than the second width.

11. The light fixture of claim 7, wherein the first mounting platform is capable of being rotated 180° relative to the second mounting platform, wherein the first light board coupling portion and the second light board coupling portion are positioned adjacent to each other without contacting each other, and wherein the first fixture coupling portion overlaps the second light board coupling portion without contacting each other.

12. The light fixture of claim 6, wherein the first housing portion further comprises at least one second component receiving feature, wherein the first mounting platform is in a first position relative to the housing when the at least one first housing receiving feature is coupled to the at least one first component receiving feature, and wherein the first mounting platform is in a second position relative to the housing when the at least one first housing receiving feature is coupled to the at least one second component receiving feature.

13. The light fixture of claim 12, further comprising:

at least one first power source mechanically coupled to the at least one first component receiving feature, wherein the at least one first power source provides power to the at least one first light board when the first mounting platform is in the first position.

14. The light fixture of claim 6, wherein the housing further comprises a second housing portion movably coupled to the first housing portion.

15. The light fixture of claim 14, wherein the second housing portion further comprises at least one second component receiving feature, wherein the at least one second component receiving feature receives at least one second housing receiving feature of a second mounting platform.

16. The light fixture of claim 6, further comprising:

a control unit operatively coupled to the first mounting platform, wherein the control unit adjusts the adjustable first angle between the first intermediate portion and the first fixture coupling portion, and wherein the control unit further adjusts the adjustable second angle between the first intermediate portion and the first light board coupling portion.

17. The light fixture of claim 16, wherein the control unit is further operatively coupled to the housing, wherein the control unit further adjusts a position of a second housing portion relative to the first housing portion.

18. The light fixture of claim 6, wherein the adjustable first angle and the adjustable second angle are adjustable independently of each other.

* * * * *